US010092910B2

(12) United States Patent
Nishio et al.

(10) Patent No.: US 10,092,910 B2
(45) Date of Patent: Oct. 9, 2018

(54) CONTAINER FOR CENTRIFUGAL SEPARATION AND ITS PRODUCTION METHOD

(71) Applicant: FUJIFILM Corporation, Tokyo (JP)

(72) Inventors: Tomonori Nishio, Ashigarakami-gun (JP); Kazuteru Nishijima, Ashigarakami-gun (JP); Toshihito Kimura, Ashigarakami-gun (JP); Toshiaki Kuniyasu, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 98 days.

(21) Appl. No.: 15/008,075

(22) Filed: Jan. 27, 2016

(65) Prior Publication Data

US 2016/0221005 A1 Aug. 4, 2016

(30) Foreign Application Priority Data

Jan. 30, 2015 (JP) ..... 2015-016712

(51) Int. Cl.

| | |
|---|---|
| ***B04B 7/08*** | (2006.01) |
| ***B04B 5/04*** | (2006.01) |
| ***B05D 1/00*** | (2006.01) |
| ***B05D 7/22*** | (2006.01) |

(52) U.S. Cl.

CPC ..... *B04B 7/08* (2013.01); *B04B 5/0407* (2013.01); *B05D 1/005* (2013.01); *B05D 7/227* (2013.01)

(58) Field of Classification Search

CPC ..... B05D 1/005; B05D 7/227; B04B 7/08; B04B 7/12; B04B 7/14; B04B 5/0407; B04B 1/02; B04B 1/04; B04B 1/08; B04B 9/14; B01D 17/0217; A61M 1/3693

USPC ..... 494/37, 43, 56, 59, 60, 67; 422/547, 422/548, 527, 72; 210/360.1, 380.1, 515

See application file for complete search history.

(56) References Cited

U.S. PATENT DOCUMENTS 4,588,556 A * 5/1986 Sarstedt ..... G01N 33/491 210/359
4,846,974 A 7/1989 Kelley et al.
4,981,585 A * 1/1991 Kelley ..... B04B 5/0407 210/138

(Continued)

FOREIGN PATENT DOCUMENTS

JP 57-16867 U 1/1982
JP 10-10122 A 1/1998

(Continued)

OTHER PUBLICATIONS

Extended European Search Report dated Jun. 13, 2016, for Eurpean Application No. 16152402.0.

(Continued)

*Primary Examiner* — Walter D. Griffin
*Assistant Examiner* — Shuyi S. Liu
(74) *Attorney, Agent, or Firm* — Birch, Stewart, Kolasch & Birch, LLP

(57) ABSTRACT

In a container for centrifugal separation that includes a container main body including a retention part in which a sample is retained, and in which a component of the sample in the retention part is centrifugally separated by rotating the container main body about its center axis, as a rotation axis, material having thixotropic properties has been applied to an entire bottom surface of the retention part.

13 Claims, 8 Drawing Sheets

(56) References Cited

U.S. PATENT DOCUMENTS

| | | | | | |
|---|---|---|---|---|---|
| 5,393,674 | A * | 2/1995 | Levine | B01L 3/50215 | 210/787 |
| 5,776,357 | A | 7/1998 | Okamoto et al. | | |
| 6,127,320 | A * | 10/2000 | van Ooij | A61M 39/045 | 508/138 |
| 7,947,186 | B2 * | 5/2011 | Soares | B01D 43/00 | 210/360.1 |
| 2004/0129631 | A1 | 7/2004 | Anraku et al. | | |
| 2014/0364296 | A1 * | 12/2014 | Monesmith | B01L 3/5021 | 494/11 |
| 2015/0374900 | A1 | 12/2015 | Nishio et al. | | |

FOREIGN PATENT DOCUMENTS

| | | | | |
|---|---|---|---|---|
| JP | 2000-175890 | A | 6/2000 | |
| JP | 2001-165928 | A | 6/2001 | |
| JP | 2001-239183 | A | 9/2001 | |
| JP | 2003-294731 | A | 10/2003 | |
| JP | 2014-208330 | A | 11/2014 | |
| WO | WO 2006/102488 | A1 | 9/2006 | |
| WO | WO 2006102488 | A1 * | 9/2006 | A61L 24/106 |

OTHER PUBLICATIONS

Japanese Office Action and English translation, dated Aug. 22, 2017, for Japanese Application No. 2015-016712.

* cited by examiner

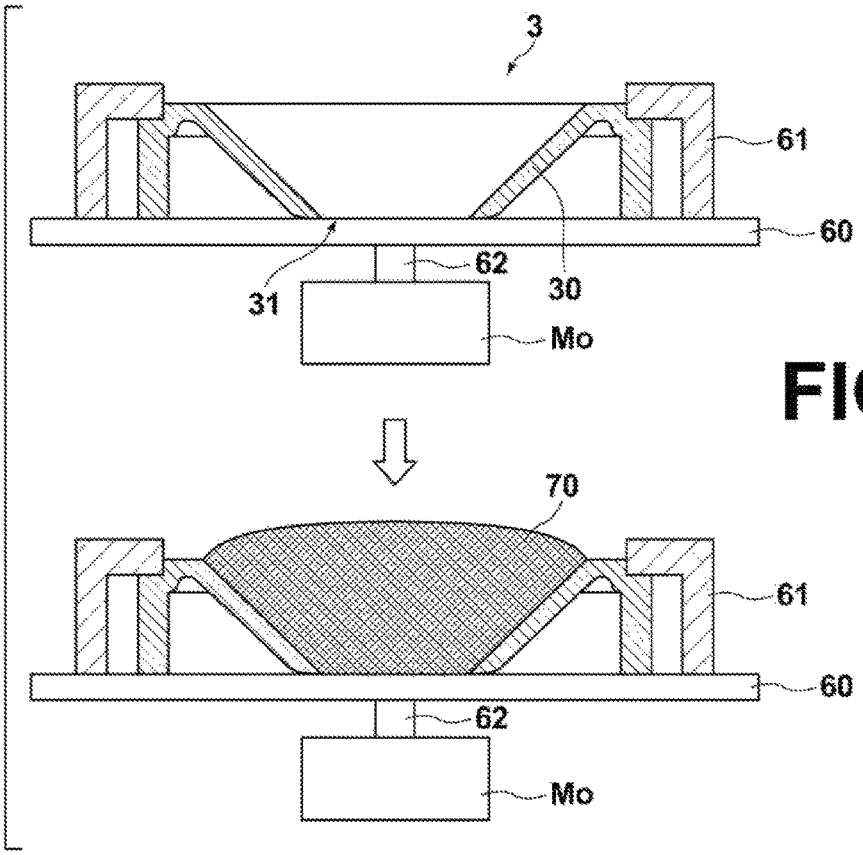
FIG.9
FIG.10
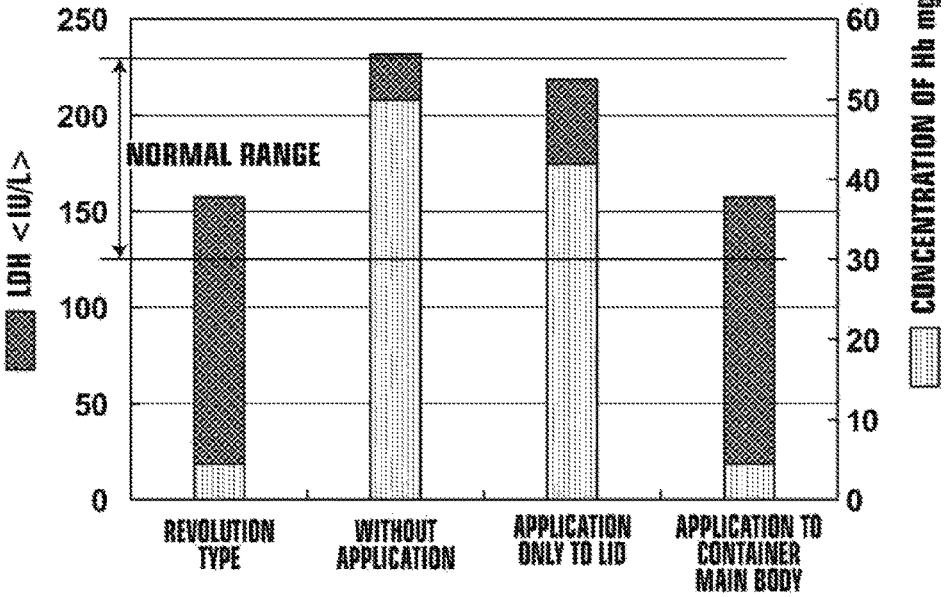

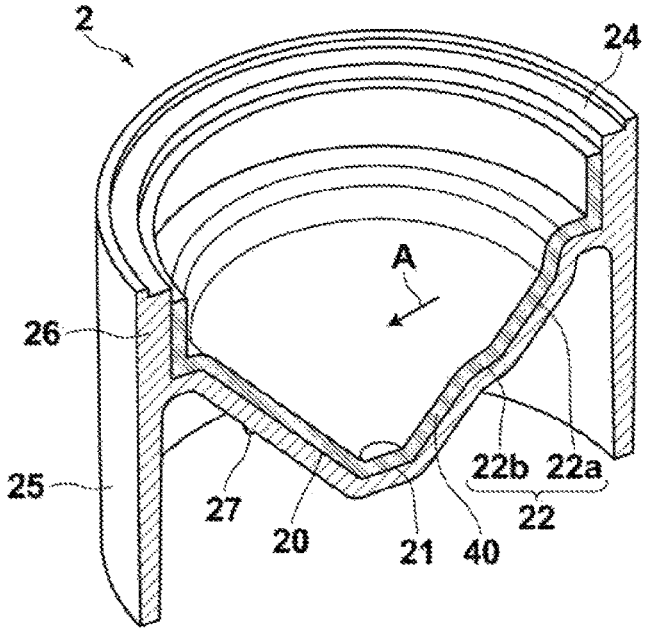
FIG.11
FIG.12
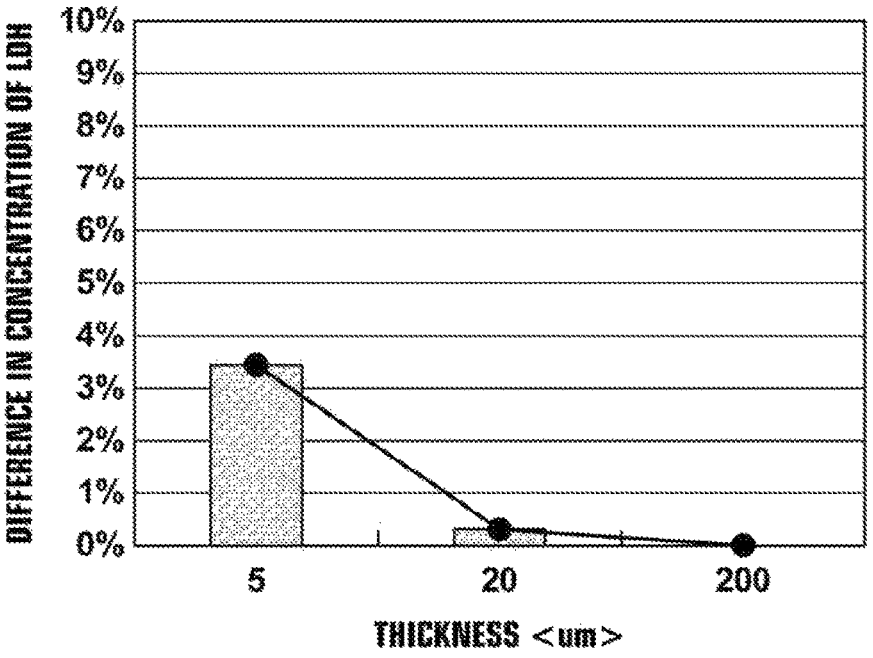

CONTAINER FOR CENTRIFUGAL SEPARATION AND ITS PRODUCTION METHOD

CROSS-REFERENCE TO RELATED APPLICATIONS

The present application claims priority under 35 U.S.C. § 119 to Japanese Patent Application No. 2015-016712, filed on Jan. 30, 2015. The above application is hereby expressly incorporated by reference, in its entirety, into the present application.

BACKGROUND

The present disclosure relates to a container for centrifugal separation used in rotation-type centrifugal separation and its production method.

Conventionally, centrifugal separation apparatuses, which centrifugally separate each component of a sample such as blood in a container, were known. As such centrifugal separation apparatuses, there are so-called revolution-type centrifugal separation apparatuses and so-called rotation-type centrifugal separation apparatuses.

FIG. 13 is a schematic diagram illustrating the configuration of a revolution-type centrifugal separation apparatus and its operation. As illustrated in FIG. 13, a revolution-type centrifugal separation apparatus performs centrifugal separation by revolving blood collection tube P1, in which blood BL and separation agent SA are stored, or the like with a closure set thereon. Specifically, each component of blood BL in blood collection tube P1 is centrifugally separated by rotating rotation shaft Q1 on which blood collection tube P1 has been set by motor M1. Accordingly, extraction of blood plasma component BP alone is possible.

Meanwhile, FIG. 14 is a schematic diagram illustrating the configuration of a rotation-type centrifugal separation apparatus and its operation. As illustrated in FIG. 14, a rotation-type centrifugal separation apparatus uses container P2 for centrifugal separation including an inclined inner wall that becomes higher from the center toward the outer circumference, and in which a retention part that retains a sample in the inside of the container is formed. Specifically, after blood BL is stored in the retention part in container P2 for centrifugal separation, container P2 for centrifugal separation itself is rotated by rotation of rotation shaft Q2 by motor M2. Centrifugal force induced by such rotation of container P2 for centrifugal separation separates each component of blood BL and separation agent SP that has been stored in advance in container P2 for centrifugal separation in such a manner that deposits are formed, in order from a component having lowest specific gravity, from the inner circumference toward the outer circumference. Then, when the rotation of the container for centrifugal separation is stopped, generally, a component having low specific gravity (blood plasma component BP) closer to the inner circumference exfoliates from the deposits, and is retained at a bottom of the container for centrifugal separation.

In the revolution-type centrifugal separation apparatus, a distance of movement of blood cells is generally long. Therefore, a relatively long time is required to separate a blood plasma component and blood cells from each other. In contrast, in the rotation-type centrifugal separation apparatus, a distance of movement of blood cells is short. Therefore, it is possible to shorten the length of time for centrifugal separation. Further, the rotation-type centrifugal separation apparatus has a merit that reduction in the size of the apparatus is possible, compared with the revolution-type centrifugal separation apparatus.

SUMMARY

However, in rotation-type centrifugal separation, blood moves upward along an inclined inner wall of a container for centrifugal separation, as illustrated in FIG. 15I. Therefore, there is a problem that hemolysis may occur by pressure of blood against the inner wall because red blood cells are pressed onto the inner wall by centrifugal force. Further, there is a problem that hemolysis may occur in a similar principle also in the vicinity of a trap space, in which deposits are formed, as illustrated in FIG. 15II.

When hemolysis has occurred, the same component as a component to be measured, a component that binds to the component to be measured or a component that reacts to a test reagent comes out from blood cells. Therefore, there is a problem that it is impossible to measure the concentration of the component to be measured or the like at high accuracy. Especially, potassium, AST (Aspartate transaminase), LDH (Lactate Dehydrogenase), Fe and the like greatly influence a measurement value, because they have high concentration in red blood cells.

Meanwhile, Japanese Unexamined Patent Publication No. 2001-239183 (Patent Document 1) discloses setting a separation agent only in a center space of a container for centrifugal separation. However, Patent Document 1 does not specially consider a structure that can suppress hemolysis as described above. Further, Specification of U.S. Pat. No. 7,947,186 (Patent Document 2) discloses radially applying a separation agent onto a bottom surface of a container for centrifugal separation. However, when the separation agent has been radially applied in such a manner, a protuberance of separation agent is formed. Therefore, hemolysis occurs by collision of blood cells with the protuberance. Further, Specification of U.S. Pat. No. 4,846,974 (Patent Document 3) discloses setting separation agent in a mass-like shape almost at a center of a bottom surface of a container for centrifugal separation. However, a structure that can suppress hemolysis is not considered at all also in Patent Document 3.

In view of the foregoing circumstances, the present disclosure provides a container for centrifugal separation that can suppress hemolysis caused by rotation-type centrifugal separation and its production method.

A container for centrifugal separation of the present disclosure includes a container main body including a retention part in which a sample is retained, and a component of the sample in the retention part is centrifugally separated by rotating the container main body about its center axis, as a rotation axis. In the container for centrifugal separation, material having thixotropic properties has been applied to an entire bottom surface of the retention part.

Further, it is desirable that the container for centrifugal separation includes a lid unit to be set toward an opening of the retention part of the container main body, and that the material having thixotropic properties has been applied also to an inner surface of the lid unit facing the retention part.

Further, it is desirable that the material having thixotropic properties has specific gravity in the middle of specific gravities of two components that are centrifugally separated from each other.

Further, it is desirable that the thickness of a coating formed by application of the material having thixotropic properties is greater than or equal to 5 μm and less than or equal to 1000 μm.

Further, the bottom surface of the retention part may include a funnel-shaped inclined surface.

Further, it is desirable that the material having thixotropic properties is gel.

Further, it is desirable that a trap part in which a component having relatively high specific gravity is stored when centrifugal separation has been performed on the sample is provided at an opening edge part of the container main body.

Further, the material having thixotropic properties may be applied to an inner surface of the trap part.

A method for producing a container for centrifugal separation of the present disclosure is a method for producing the aforementioned container for centrifugal separation of the present disclosure, and the material having thixotropic properties is applied by spin coating.

According to the container for centrifugal separation of the present disclosure, the container includes a container main body including a retention part in which a sample is retained, and a component of the sample in the retention part is centrifugally separated by rotating the container main body about its center axis, as a rotation axis. In the container for centrifugal separation, material having thixotropic properties has been applied to an entire bottom surface of the retention part. Therefore, it is possible to lower pressure received by blood cells in blood, compared with a case in which blood is in direct contact with the bottom surface of the retention part. As a result, it is possible to effectively suppress hemolysis of blood.

BRIEF DESCRIPTION OF THE DRAWINGS

FIG. 8II is a schematic diagram illustrating the specific example of the container for centrifugal separation of the present disclosure;

FIG. 9 is a diagram for explaining a method for forming a coating on an inner surface of a lid unit;

FIG. 10 is a chart showing a result of measuring the concentration of LDH and the concentration of Hb (hemoglobin) in a blood plasma component separated by centrifugal separation;

FIG. 11 is a diagram for explaining a method for measuring the thickness of a coating made of material having thixotropic properties;

FIG. 12 is a chart showing a result of measuring a relationship between the thickness of a coating made of material having thixotropic properties and the concentration of LDH;

FIG. 15II is a diagram for explaining the mechanism of occurrence of hemolysis.

DETAILED DESCRIPTION OF THE PREFERRED EMBODIMENTS

Figure 1:
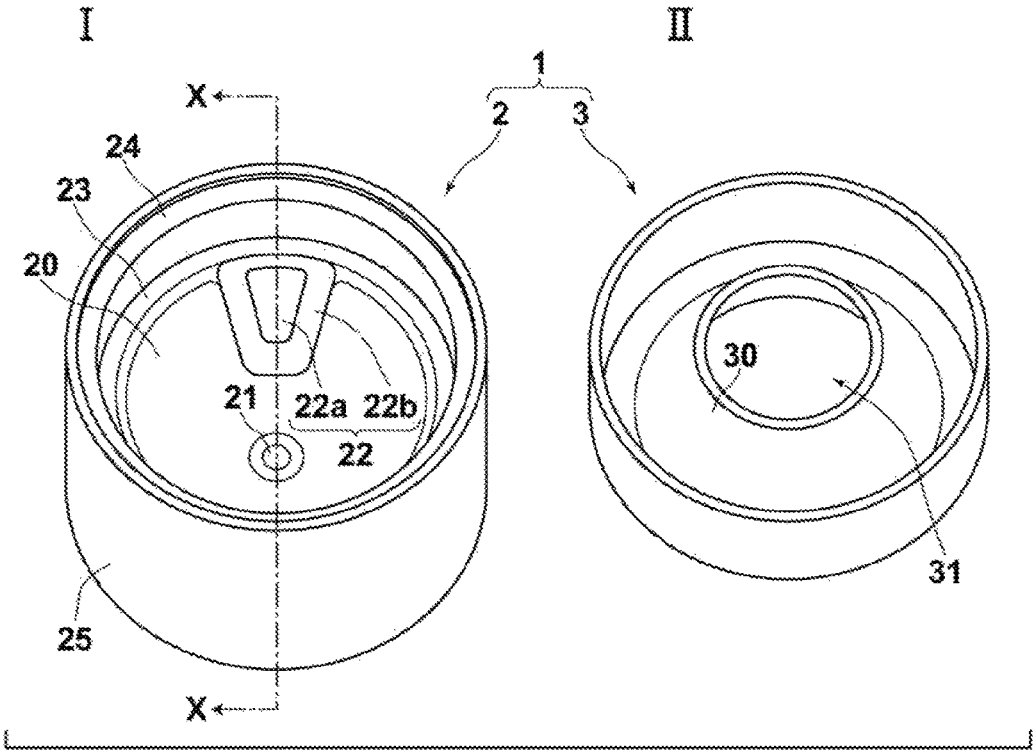
FIG. 1 is a schematic diagram illustrating the structure of a container for centrifugal separation according to an embodiment of the present disclosure.

Hereinafter, an embodiment of a container for centrifugal separation of the present disclosure will be described in detail with reference to drawings. Here, the scale or the like of each composition element in the drawings appropriately differs from the actual one to make it easily recognizable.

Figure 2:
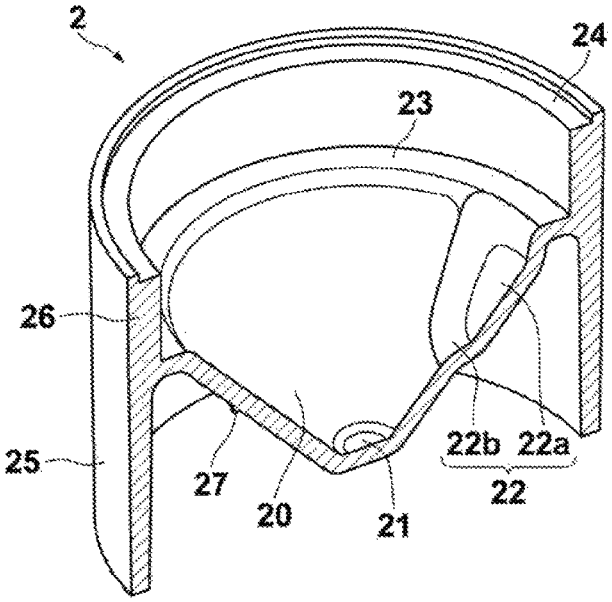
FIG. 2 is a schematic perspective view of X-X cross section of a container main body.
Figure 3:
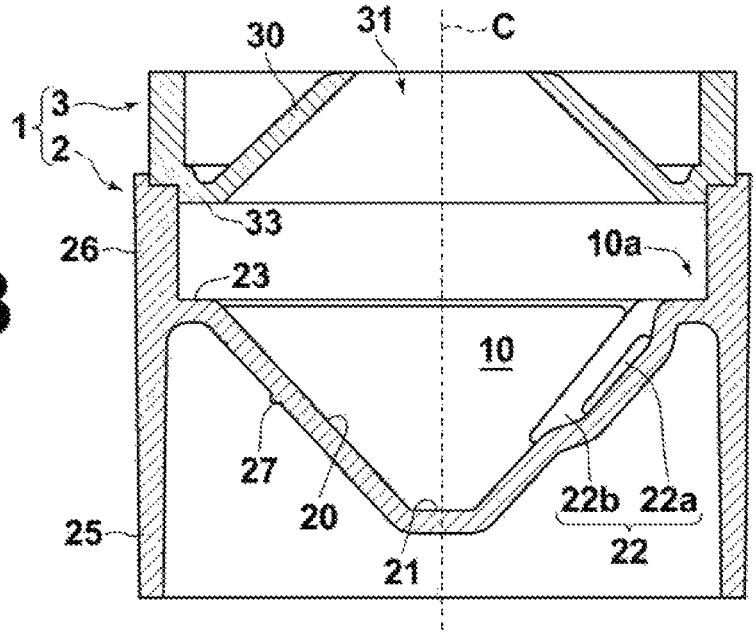
FIG. 3 is a schematic sectional view illustrating an internal structure of the container main body at X-X cross section.
Figure 4:
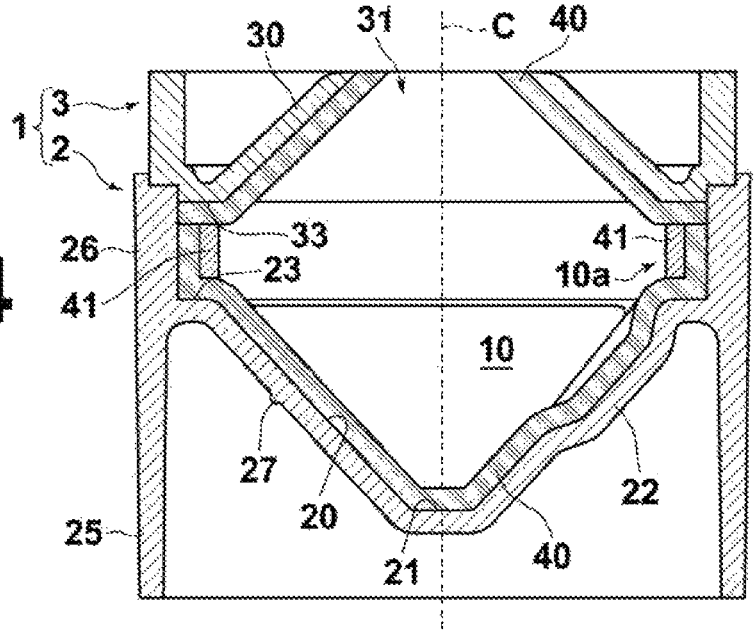
FIG. 4 is a diagram illustrating a state in which material having thixotropic properties has been applied to the entire bottom surface of a retention part of the container for centrifugal separation.

FIG. 1 is a schematic diagram illustrating the structure of a container 1 for centrifugal separation according to the present embodiment. Specifically, Section I of FIG. 1 is a perspective view of a container main body 2 of the container 1 for centrifugal separation. Section II of FIG. 1 is a perspective view of a lid unit 3 of the container 1 for centrifugal separation. Further, FIG. 2 is a schematic perspective view of X-X cross section of the container main body 2 illustrated in FIG. 1. FIG. 3 is a schematic sectional view illustrating an internal structure of the container main body 2 at X-X cross section. In the container 1 for centrifugal separation of the present embodiment, material having thixotropic properties has been applied to an entire bottom surface of the retention part. However, FIG. 1 through FIG. 3 illustrate a state before application of the material having thixotropic properties. Meanwhile, FIG. 4 is a schematic sectional view illustrating a state after application of the material having thixotropic properties.

As illustrated in FIG. 1 through FIG. 3, the container 1 for centrifugal separation of the present embodiment includes the container main body 2 and the lid unit 3. The container main body 2 includes an inclined inner wall part 20, a bottom part 21, a trap bottom surface part 23, a trap side surface part 26, a fitting part 24, which is to be fitted with the lid unit 3, and a support outer wall part 25, which supports these parts. The lid unit 3 includes an opening part 30, in which an opening 31 for injecting a sample is formed, and a trap upper surface part 33, which forms a trap space 10*a* together with the trap bottom surface part 23 and the trap side surface part 26 when the lid unit 3 is fitted with the container main body 2.

The container 1 for centrifugal separation has a structure that is symmetric with respect to an axis (center axis C of the container) that passes through a center of the bottom part 21 and is perpendicular to the bottom part 21 (in other words, a structure similar to a rotation body about center axis C, as a center). Further, the container 1 for centrifugal separation has a cylindrical shape when viewed from the outside. When centrifugal separation is performed, the lid unit 3 in a state of being fitted with the fitting part 24 of the container main body 2 is, for example, firmly fixed to the fitting part 24, and the container 1 for centrifugal separation is rotated about center axis C, as a rotation axis.

As illustrated in FIG. 3, a retention space 10, into which a sample is injected, is formed by fitting the container main body 2 and the lid unit 3 together. Specifically, this retention space 10 is a space surrounded by the inclined inner wall part 20, the bottom part 21, the trap bottom surface part 23, the trap side surface part 26, the trap upper surface part 33 and the opening part 30. In this retention space 10, especially the space 10*a*, formed by the trap bottom surface part 23, the trap side surface part 26 and the trap upper surface part 33, is a trap space in which a component having high specific gravity is trapped when centrifugal separation has been performed on a sample by rotating the container. In other words, the inclined inner wall part 20, the bottom part 21, the trap bottom surface part 23, the trap side surface part 26, the trap upper surface part 33 and the opening part 30 correspond to the retention part of the present disclosure. Further, the trap bottom surface part 23, the trap side surface part 26 and the trap upper surface part 33 correspond to the trap part of the present disclosure.

The inclined inner wall part 20 is a funnel-shaped inclined surface, and formed in such a manner that the diameter of a cross section of the opening of the retention space 10 is tapered from its opening edge. A lower part of the retention space 10 is formed by this inclined surface. Further, a depression portion 22 is formed on a part of the inclined inner wall part 20. The depression portion 22 has a depression portion side surface 22*b* formed in such a manner that the diameter of a cross section of the opening of the depression portion 22 is tapered from its opening edge. The depression portion side surface 22*b* is connected to a depression portion bottom surface 22*a*.

Here, it is desirable that a connection part between the inclined inner wall part 20 and the depression portion side surface 22*b* has curvature to prevent hemolysis of a sample. Further, it is desirable that a connection part between the depression portion bottom surface 22*a* and the depression portion side surface 22*b* also has curvature. The depression portion 22 will be described later in detail.

Further, the inclined inner wall part 20 has a projection portion 27 in such a manner that the position of the projection portion 27 and that of the depression portion 22 are symmetric with respect to center axis C. The projection portion 27 is provided to adjust the position of the center of gravity of the container 1 for centrifugal separation itself that might have been shifted by formation of the depression portion 22 on the inclined inner wall part 20. In the present embodiment, only one depression portion 22 is formed on the inclined inner wall part 20. However, as a result of forming this single depression portion 22 alone, there is a possibility that the position of the center of gravity of the container 1 for centrifugal separation of the present embodiment is shifted from a designed center axis of the container. If such a shift in the position of the center of gravity is large, that is not desirable, because rotation of the container 1 for centrifugal separation becomes unstable.

Therefore, in the present embodiment, a difference in the moment of inertia induced by a shift in the position of a part (the part of the depression portion) of the inclined inner wall part 20 away from center axis C is offset by providing the projection portion 27. Consequently, a position at which the projection portion 27 has been formed and a position at which the depression portion 22 has been formed are symmetric with respect to center axis C, and mass at the position at which the projection portion 27 has been formed is large. Further, a structure for adjusting such balance of the container 1 for centrifugal separation is not limited to the projection-shaped structure. For example, a structure in which material having high density has been embedded in the inclined inner wall part 20 in such a manner that a position at which the material has been embedded and the position at which the depression portion 22 has been formed are symmetric with respect to center axis C is adoptable. Alternatively, a structure that adjusts balance may be provided on or in the support outer wall part 25 instead of the inclined inner wall part 20. Here, if a shift in the position of the center of gravity is not large (if the noise and vibration of the apparatus is not a problem, or the like), it is not always necessary to form the projection portion 27.

The bottom part 21 connected to a lower edge of the inclined inner wall part 20 includes a flat surface connected to the lower edge of an inclined surface of the inclined inner wall part 20. A connection part between the lower edge of the inclined surface and the flat surface is formed in such a manner to have curvature.

Here, it is not necessary that the bottom part 21 is flat. The bottom part 21 may be a convex curved surface. The container 1 for centrifugal separation is rotated about center axis C as a center. Therefore, centrifugal separation of a sample in the vicinity of center axis C tends to be difficult. However, if the bottom part 21 is formed by a convex curved surface, it is possible to further improve the centrifugal separation performance of the container 1 for centrifugal separation. This is because when the bottom part 21 is formed by the convex curved surface, force in a direction away from center axis C (this force is a gravity component along the curved surface) acts on the sample in the vicinity of the bottom part 21 during injection of the sample, and as a result, the sample in the vicinity of the bottom part 21 does not remain in the vicinity of center axis C but easily moves away from center axis C during rotation of the container 1 for centrifugal separation, and centrifugal force more efficiently acts on the sample.

The trap bottom surface part 23 connected to an upper edge of the inclined inner wall part 20 includes a horizontal flat surface. Further, a connection part between the flat surface and the upper edge of the inclined surface of the inclined inner wall part 20 is formed in such a manner to have curvature. This flat surface forms a bottom surface of the trap space 10*a*. The trap side surface part 26 includes a vertical surface, which is connected to the flat surface of the trap bottom surface part 23 in such a manner to be perpendicular to the flat surface. This vertical surface forms a side surface of the trap space 10*a*.

The trap space 10*a* has a ring shape with center axis C as its center, and the volume of the trap space 10*a* is designed based on the amount of sample to be injected.

The support outer wall part 25 extends downward from the trap side surface part 26 while surrounding the whole inclined inner wall part 20, and a lower edge of the support outer wall part 25 is located lower than the bottom part 21. Accordingly, the container main body 2 is stably supported by the support outer wall part 25.

The opening part 30 of the lid unit 3 has, for example, a truncated conical shape. The opening part 30 has an inclined surface formed in such a manner that the diameter of a cross section of the opening is tapered toward the opening 31. An upper part of the retention space 10 is formed by this inclined surface. In the present embodiment, the container 1 for centrifugal separation is rotated while the opening 31 is kept open. Alternatively, the opening 31 may be structured in such a manner to be openable and closable, if necessary. The trap upper surface part 33 connected to the lower edge of the opening part 30 includes a substantially horizontal flat surface that is connected to the lower edge of the inclined surface of the opening part 30 in such a manner to have curvature. This flat surface forms the upper surface of the trap space 10*a*.

Further, as described above, FIG. 4 illustrates a state in which a coating 40 has been formed by applying material having thixotropic properties to the entire bottom surface of the retention part of the container 1 for centrifugal separation, illustrated in FIG. 1 through FIG. 3. The retention part is formed by the inclined inner wall part 20, the bottom part 21, the trap bottom surface part 23, the trap side surface part 26, the trap upper surface part 33 and the opening part 30, as described above, and the bottom surface of the retention part includes at least an inner surface of the bottom part 21 and an inner surface of the inclined inner wall part 20. Further, the expression "applying material to the entire bottom surface" means that it is not always necessary that the material is applied exactly to 100% of the bottom surface, and that an effect of suppressing hemolysis at the same level as the case of applying the material to substantially 100% of the bottom surface should be obtainable. A generally allowable error, such as a production error, is about 5%. Therefore, the material should be applied, for example, to at least 90% of the inner surface of the inclined inner wall part 20. Further, it is desirable that the material having thixotropic properties is evenly applied continuously without a break. It is desirable that the material is evenly applied continuously without a break especially for the rotation direction of the container 1 for centrifugal separation (the circumference direction of the retention part).

Further, it is desirable that material having thixotropic properties is applied not only to the bottom surface of the retention part but also to the inner surface of the trap bottom surface part 23, the inner surface of the trap side surface part 26, the inner surface of the trap upper surface part 33 and the inner surface of the opening part 30, as illustrated in FIG. 4. Blood is in contact also with these inner surfaces during centrifugal separation. Therefore, if the material is applied also to these inner surfaces, it is possible to suppress also hemolysis that may occur by contact of blood with these inner surfaces.

As the aforementioned material having thixotropic properties, material in a gel state that is usable as so-called separation agent may be used. The separation agent is appropriately selected, based on a component having low specific gravity and a component having high specific gravity to be separated from each other in a sample, from materials having specific gravity in the middle of the specific gravity of the component having low specific gravity and the specific gravity of the component having high specific gravity. Specifically, when blood plasma (a component having low specific gravity) and blood cells (a component having high specific gravity) in blood are separated from each other, a material having specific gravity in the middle of the specific gravity of blood plasma and the specific gravity of blood cells should be selected.

The coating 40 having thixotropic properties functions as a separation agent, and also functions as a protection coating for suppressing hemolysis.

Specifically, as material having thixotropic properties, for example, S Collect (Registered Trademark)(manufactured by SEKISUI MEDICAL CO, LTD.) or PS-Gel (manufactured by NIPPOINPAINT Co., Ltd.) may be used. Alternatively, material that is generally used as a separation agent may be used besides these kinds of material. Composition for separation disclosed, for example, in Japanese Unexamined Patent Publication No. 2003-294731, Japanese Unexamined Patent Publication No. 2001-165928 or Japanese Unexamined Patent Publication No. 10(1998)-010122 may be used.

Further, it is desirable that the thickness of the coating 40 made of material having thixotropic properties is greater than or equal to 5 μm and less than or equal to 1000 μm. Since the size of red blood cells is 7 μm through 8 μm, it is desirable that the thickness is 5 μm or greater, which is at least half of the diameter of a red blood cell, to sufficiently achieve an effect of suppressing hemolysis. Further, 200 μm or greater is more desirable. Further, as described above, the coating 40 made of material having thixotropic properties flows into the trap space 10*a* when centrifugal separation has been performed, and functions also as a separation agent. However, if a large amount of material flows, the thickness of a layer of separation agent formed in the trap space 10*a* becomes great. Therefore, a long time is needed to perform separation. Hence, it is desirable that the thickness of the coating 40 having thixotropic properties is less than or equal to 1000 μm. Here, the thickness of the coating 40 means an average thickness of the evenly formed coating 40 applied to the inner surface of the inclined inner wall 20 excluding the depression portion 22. Further, the expression "an average thickness is X μm" means that the maximum value and the minimum value of the thickness of the coating are within the range of X±10%.

Further, the coating 40 may be formed by applying material having thixotropic properties by spin coating. The conditions for producing the coating, such as conditions of spin coating, will be described later in detail.

Further, the trap space 10*a* after formation of the coating 40 is filled with a separation agent 41. In the present embodiment, the material of the separation agent 41 and the material of the coating 40 are the same material.

Figure 5:
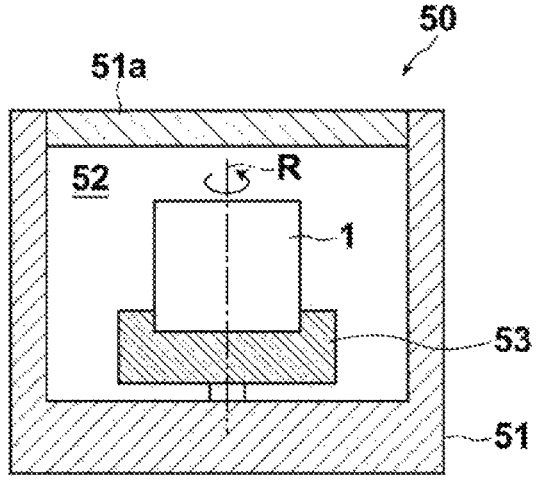
FIG. 5 is a diagram illustrating an example of a centrifugal separation apparatus.

Further, centrifugal separation is performed, for example, by using a centrifugal separation apparatus 50, as illustrated in FIG. 5. The centrifugal separation apparatus 50 includes a casing 51 that has an open-close lid 51*a* and forms a storage space 52 for storing the container 1 for centrifugal separation, and a rotation table 53 that is provided in the storage space 52, and on which the container 1 for centrifugal separation is mounted. The container 1 for centrifugal separation is stored in the storage space 52 in a state in which the open-close lid 51*a* is open, and mounted on the rotation table 53. The rotation table 53 is rotationably supported by a rotation mechanism (for example, a motor or the like), which is not illustrated. The rotation table 53 rotates the container 1 for centrifugal separation in a state in which center axis C of the container 1 for centrifugal separation mounted on the rotation table 53 and rotation axis R of the rotation table 53 coincide with each other.

Figure 6:
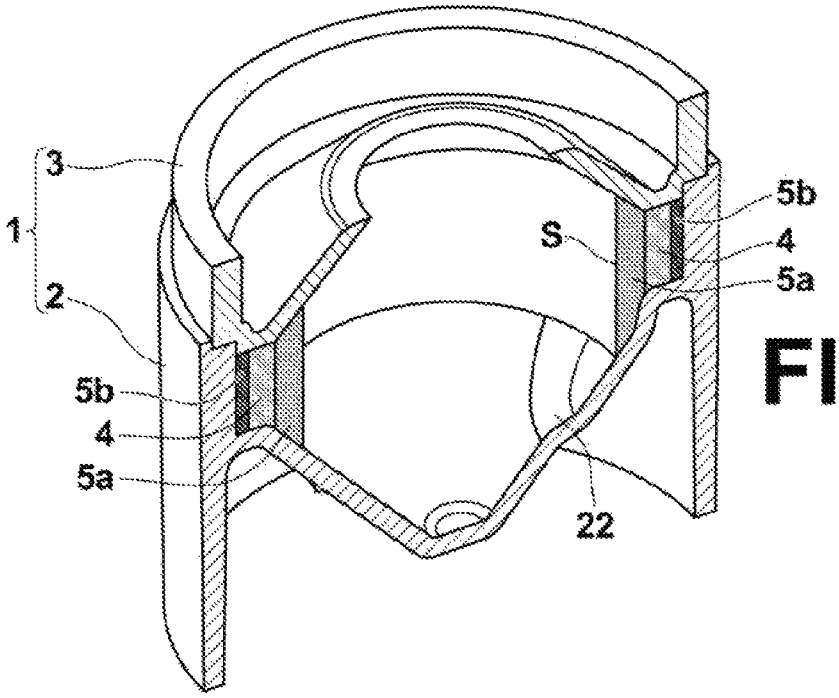
FIG. 6 is a schematic sectional perspective view illustrating a state of the inside of the container for centrifugal separation during centrifugal separation.

Next, the depression portion 22 on the inclined inner wall part 20 will be described in detail. FIG. 6 is a schematic sectional perspective view illustrating the state of the inside of the container for centrifugal separation during centrifugal separation. FIG. 6 illustrates a state in which deposits, as a resultant of centrifugal separation, have been formed in a region closer to the outer circumference of the retention space 10 as a result of performing centrifugal separation on a sample including a component 5*a* having low specific gravity and a component 5*b* having high specific gravity. These deposits have a structure in which a layer of the component 5*a* having low specific gravity, a separation layer 4, and a layer of the component 5*b* having high specific gravity are present in this order from the inner circumference side. Here, the separation layer 4 is a layer formed of the aforementioned separation agent 41 filled in the trap space 10*a* and the material of the coating 40 that has flowed into the trap space 10*a*.

Further, as illustrated in FIG. 6, the depression portion 22 is formed at a position in such a manner that the depression portion 22 crosses interface S between a sample that was moved away from a center during rotation (after centrifugal separation, especially the component 5*a* having low specific gravity) and air. Accordingly, a part of the component 5*a* having low specific gravity that is present on the depression portion 22 easily exfoliates from the deposits, compared with the other part of the component 5*a* present in the other area.

It is desirable that the shape of the depression portion 22 is a sector with center axis C, as a center (including a truncated sector, in which a part including the center of a sector has been cut off) to reduce an obstacle when a sample moves up on the inclined surface of the inclined inner wall part 20 and when the component having low specific gravity moves down on the inclined surface of the inclined inner wall part 20.

Figure 7:
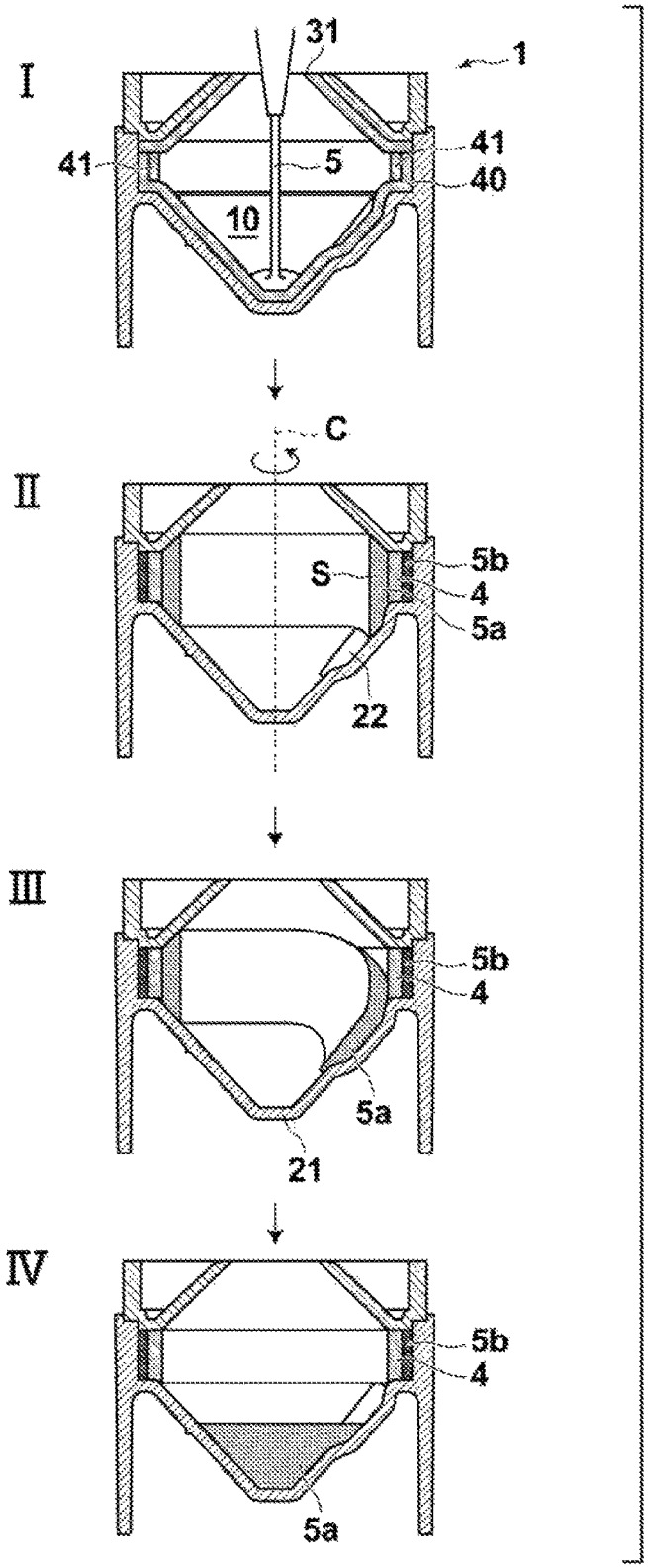
FIG. 7 is a diagram illustrating steps of centrifugal separation.

Next, process of a centrifugal separation method using the container 1 for centrifugal separation and the centrifugal separation apparatus 50, as described above, will be described. FIG. 7 is a schematic sectional diagram illustrating steps of the centrifugal separation method.

First, the aforementioned container 1 for centrifugal separation in which material having thixotropic properties has been applied to the entire bottom surface of the retention part is prepared. Further, a sample 5 is injected to the retention space 10 from the opening 31 of the container 1 for centrifugal separation (Section I of FIG. 7). The sample 5 is injected, for example, by using a pipette or a syringe.

Next, the container 1 for centrifugal separation in which the sample 5 has been injected is mounted onto the rotation table 53 of the centrifugal separation apparatus 50 and rotated. At this time, components of the sample 5 and the material having thixotropic properties are separated according to specific gravity by centrifugal force of rotation, and deposits are formed closer to the outer circumference of the retention space 10 (section II of FIG. 7). A component 5*b* having high specific gravity is trapped in the trap space 10*a* by a trap part (the trap bottom surface part 23, the trap side surface part 26 and the trap upper surface part 33) and the separation agent 4 (material having thixotropic properties).

Next, when rotation of the container 1 for centrifugal separation stops, exfoliation of a part of the component 5*a* having low specific gravity that is present on the depression portion 22 starts by presence of the depression portion 22, as a trigger (section III of FIG. 7). Further, exfoliation of the other part of the component 5*a* gradually progresses in such a manner to follow the exfoliation of the part of the component 5*a* on the depression portion 22. Meanwhile, the component 5*b* having high specific gravity remains, as it is, in the trap space. Then, when all the component 5*a* having low specific gravity exfoliates from the deposits, the component 5*a* having low specific gravity accumulates in a lower part of the retention space 10, and a state in which the component 5*a* having low specific gravity alone has been extracted and become collectable is induced (section IV of FIG. 7).

EXAMPLE 1

Next, specific examples of the container for centrifugal separation of the present disclosure and its effects will be described.

Figure 8I:
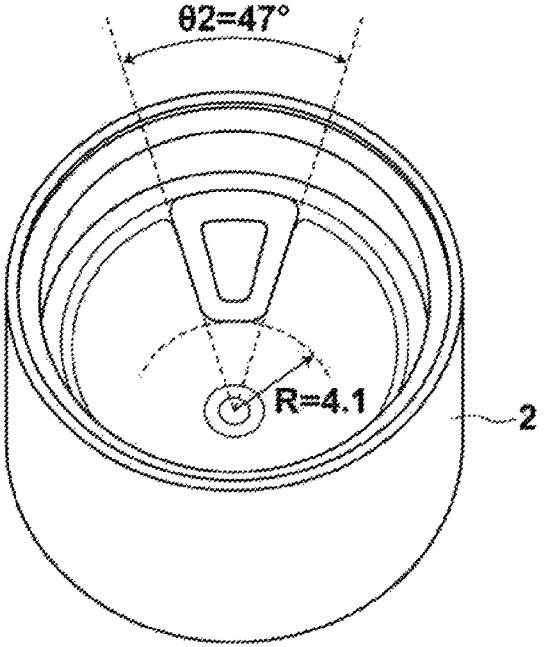
FIG. 8I is a schematic diagram illustrating a specific example of the container for centrifugal separation of the present disclosure.
Figure 8I:
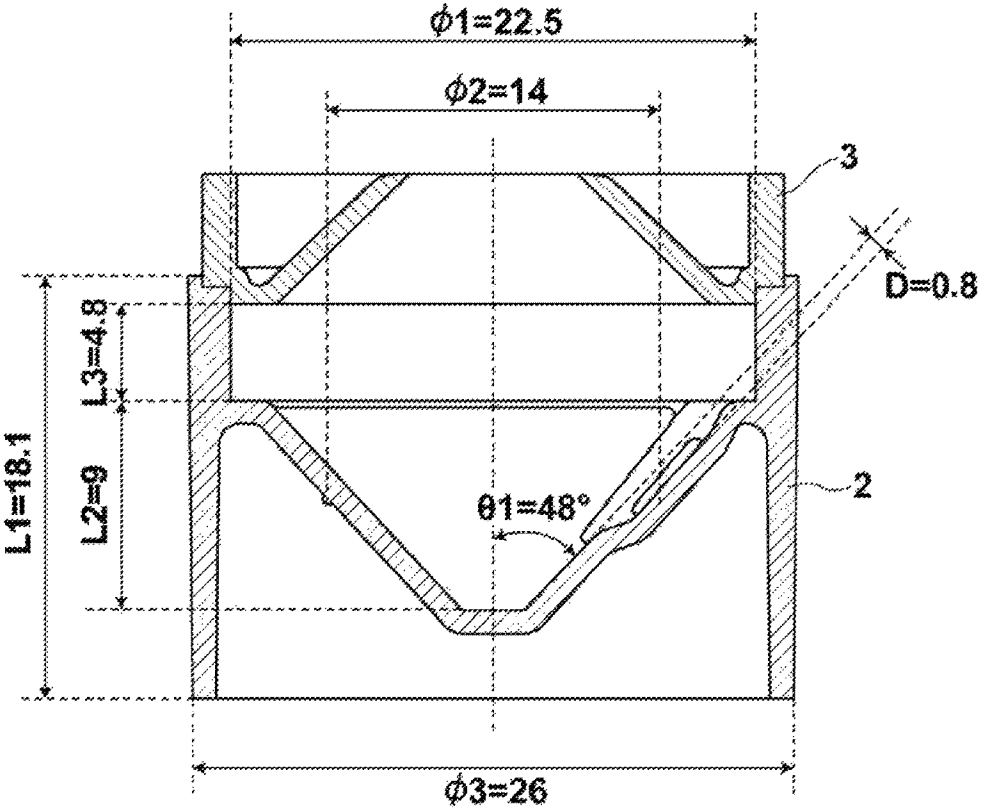
Figure 13:
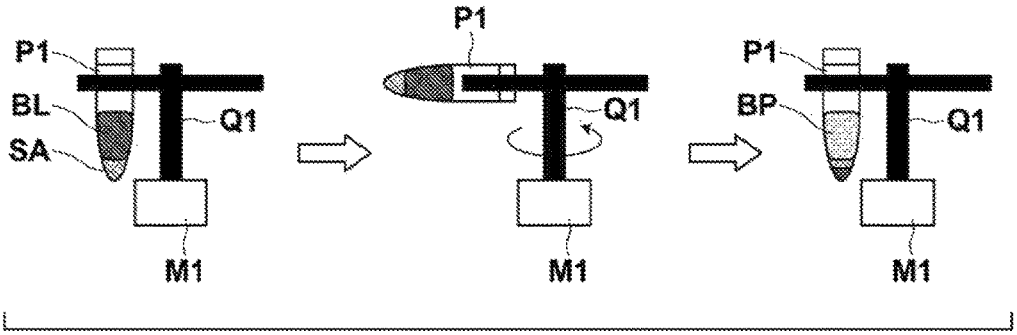
FIG. 13 is a schematic diagram illustrating the structure of a revolution-type centrifugal separation apparatus and its operation.
Figure 14:
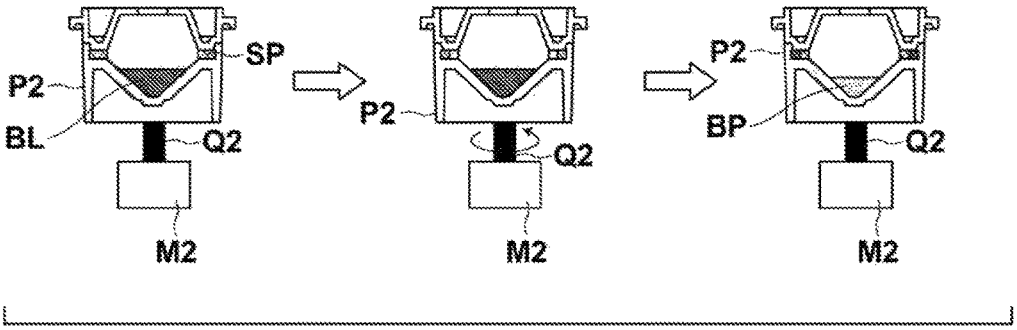
FIG. 14 is a schematic diagram illustrating the structure of a rotation-type centrifugal separation apparatus and its operation.
Figure 15:
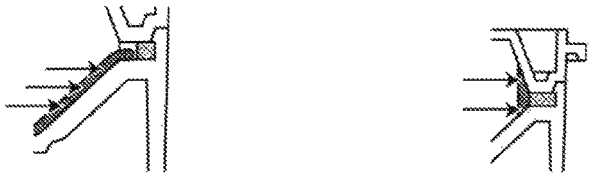
FIG. 15I is a diagram for explaining the mechanism of occurrence of hemolysis.

FIG. 8I is a sectional diagram illustrating a container for centrifugal separation of the present example. FIG. 8II is a perspective view illustrating the container for centrifugal separation of the present example. FIGS. 8I and 8II illustrate a state of the container for centrifugal separation before the aforementioned material having thixotropic properties is applied. The specific size of main structures of the container for centrifugal separation illustrated in FIGS. 8I and 8II is as follows:

diameter φ1 of a trap space=22.5 mm;

diameter φ2 of a circumference including a projection portion for adjusting balance=14 mm;

diameter φ3 of the whole container=26 mm;

height L1 of a main body member=18.1 mm;

depth L2 of a space formed by an inclined inner wall part=9 mm;

height L3 of a trap space=4.8 mm;

depth D of a depression portion=0.8 mm;

angle θ1 formed by an inclined surface of the inclined inner wall part and a center axis=48°;

angular range θ2 occupied by the depression portion in a circumferential direction=47°; and distance R from a center of a bottom part to the depression portion along the inclined surface of the inclined inner wall part=4.1 mm.

Here, 0.5 g of S Collect (Registered Trademark)(manufactured by SEKISUI MEDICAL CO, LTD.) was dispensed in the retention part of the container main body 2 of the container for centrifugal separation illustrated in FIGS. 8I and 8II by using a syringe. The container main body 2 was set in a centrifugal separation apparatus, and spin coating was performed by rotating the container main body 2 at 15000 $min^{-1}$ for 30 seconds (including 10 seconds for acceleration and 10 seconds for deceleration). As a result, a coating having the thickness of 200 μm was formed on the entire bottom surface of the retention part of the container main body 2.

Further, material having thixotropic properties was applied also to the inner surface of the lid unit 3 of the container for centrifugal separation illustrated in FIG. 8I. Specifically, as illustrated in FIG. 9, the lid unit 3 was set on the rotation table 60 of the centrifugal separation apparatus with the opening 31 directed downward, and fixed by a press member 61. Then, a space in the inner surface of the lid unit 3 was filled with material 70 having thixotropic properties, and spin coating was performed by rotating the lid unit 3 at 15000 $min^{-1}$ for 30 seconds (including 10 seconds for acceleration and 10 seconds for deceleration). As a result, a coating having the thickness of 200 μm was formed on the entire inner surface of the lid unit 3.

After the coating was formed on the inner surface of the container main body 2 and the lid unit 3 as describe above, the container main body 2 and the lid unit 3 were fitted together and welded by ultrasonic waves.

In the present example, after the coating was formed on each of the container main body 2 and the lid unit 3, the container main body 2 and the lid unit 3 were joined together to form the container 1 for centrifugal separation. However, it is not necessary that the container 1 for centrifugal separation is formed in such a manner. After the container main body 2 and the lid unit 3 are joined together, the coating may be formed in a similar manner to the above method by dispensing 0.5 g of S Collect (Registered Trademark) (manufactured by SEKISUI MEDICAL CO, LTD.) by using a syringe, and by performing spin coating by rotating the container for centrifugal separation by using the centrifugal separation apparatus.

Then, centrifugal separation was performed on whole blood of a man (male) of 45 years of age by using the container for centrifugal separation to which material having thixotropic properties had been applied as described above, and LDH (Lactate Dehydrogenase) in a separated blood plasma component was measured. The whole blood had been collected by using a heparin blood collection tube. Centrifugal separation was performed by rotating the whole blood at 18000 $min^{-1}$ for 2 minutes. Measurement of LDH was performed by using FDC7000 (manufactured by FUJIFILM Corporation).

Further, for the purpose of comparing the above case with a case in which centrifugal separation was performed by using a revolution-type centrifugal separation apparatus, centrifugal separation was performed on the whole blood by using ACNO3 (manufactured by Atom vet's medical), as the revolution-type centrifugal separation apparatus, and the concentration of LDH and the concentration of Hb (hemoglobin) in the blood plasma component were measured. Centrifugal separation was performed by rotating the whole blood at 8000 $min^{-1}$ for 10 minutes. LDH is a component contained in red blood cells, as described above, and the concentration of Hb (hemoglobin) is a diagnosis item and usable as an index indicating hemolysis. Therefore, these two concentrations were measured.

FIG. 10 illustrates the concentration of LDH and the concentration of Hb (hemoglobin) in a blood plasma component that has been centrifugal separated. Here, IU/L, which is the unit of the concentration of LDH illustrated in FIG. 10, is convertible by 1 IU/L=$1.67\times10^{-6}$ kat/L.

The leftmost graph in FIG. 10 represents the concentration of LDH and the concentration of Hb (hemoglobin) in a blood plasma component that has been centrifugally separated by revolution-type centrifugal separation. The second graph from the left in FIG. 10 represents the concentration of LDH and the concentration of Hb (hemoglobin) in a blood plasma component that has been centrifugally separated by rotation-type centrifugal separation without applying material having thixotropic properties to the container for centrifugal separation. Further, the third graph from the left in FIG. 10 represents the concentration of LDH and the concentration of Hb (hemoglobin) in a blood plasma component that has been centrifugally separated by rotation-type centrifugal separation after applying material having thixotropic properties to the inner surface of the lid unit of the container for centrifugal separation. The rightmost graph in FIG. 10 represents the concentration of LDH and the concentration of Hb (hemoglobin) in a blood plasma component that has been centrifugally separated by rotation-type centrifugal separation after applying material having thixotropic properties to the entire bottom surface of the retention part in the container for centrifugal separation.

The graphs in FIG. 10 show that the measurement result of the concentration of LDH and the concentration of hemoglobin when the material having thixotropic properties was applied to the entire bottom surface of the retention part in the container for centrifugal separation is closest to the measurement result of the concentration of LDH and the concentration of hemoglobin obtained when the revolution-type centrifugal separation was performed. Specifically, it was found out that effective suppression of hemolysis was possible when material having thixotropic properties had been applied to the entire bottom surface of the retention part in the container for centrifugal separation. It was found out that when the material having thixotropic properties had not been applied, or when the material having thixotropic properties had been applied only to the inner surface of the lid unit, the concentration of Hb was relatively high by the influence of hemolysis, and that the concentration of LDH was a value closest to an upper limit in a normal range. When the material having thixotropic properties had been applied to the lid unit, some improvement was observed. Therefore, a more excellent effect is achievable when the material is applied to both of the entire bottom surface of the retention part and the inner surface of the lid unit.

Next, an example representing a relationship between the thickness of the coating 40 made of material having thixotropic properties and an effect of suppressing hemolysis will be described. Here, the concentration of LDH was measured for each of a case in which the coating 40 with the thickness of 200 μm was formed, a case in which the coating 40 with the thickness of 20 μm was formed, and a case in which the coating 40 with the thickness of 5 μm was formed. The coating 40 for each thickness was formed by spin coating. Specifically, 0.5 g of S Collect (Registered Trademark) (manufactured by SEKISUI MEDICAL CO, LTD.) was dispensed by using a syringe, and the container main body 2 was set in a centrifugal separation apparatus, and rotated at 15000 $min^{-1}$ for 30 seconds in a similar manner to the aforementioned example. As a result, the coating 40 of 200 μm was formed. The container main body 2 was rotated at the same rotation number for 120 seconds, and as a result, the coating 40 of 20 μm was formed. The container main body 2 was rotated at the same rotation number for 150 seconds, and as a result, the coating 40 of 5 μm was formed.

Regarding the thickness of the coating 40, the thickness of the coating 40 formed on the inner surface of the inclined inner wall part 20 at a point indicated by arrow A, as illustrated in FIG. 11, was measured. As a measuring machine, a multi-layer coating thickness measuring machine SI-T10/SI-T10U manufactured by KEYENCE CORPORATION was used. Further, in the present example, the coating 40 was formed by spin coating. Therefore, the thickness of the coating 40 formed on the inner surface of the inclined inner wall part 20 is almost even, and the maximum value and the minimum value of thickness are within the range of ±10% of an average thickness.

FIG. 12 uses, as a base (zero), the concentration of LDH when LDH in a blood plasma component was measured after performing centrifugal separation by using the container 1 for centrifugal separation in which the coating 40 of 200 μm was formed. With respect to this base, FIG. 12 illustrates a difference in concentration when LDH was measured after forming the coating 40 of 20 μm and a difference in concentration when LDH was measured after forming the coating 40 of 5 μm was formed. As illustrated in FIG. 12, it has been found out that a difference in concentration of LDH increases and the effect of suppressing hemolysis becomes lower, as the thickness of the layer 40 becomes less. When the thickness of the coating 40 is 5 μm, a difference in concentration from the base is 3.5%. Therefore, it is desirable that this thickness is set as a lower limit.

In the above explanation, only the effect for the influence of hemolysis caused by destruction of red blood cells was described. However, it is conceivable that the container for centrifugal separation of the present disclosure has a protection function also for destruction of white blood cells and the like.

What is claimed is:

1. A container for centrifugal separation comprising:

a container main body including a retention part in which a sample is retained, wherein a component of the sample in the retention part is centrifugally separated by rotating the container main body about its center axis, as a rotation axis, and wherein material having thixotropic properties has been applied to an entire bottom surface of the retention part; and a lid unit provided at an opening of the retention part of the container main body, wherein the material having thixotropic properties has been evenly coated continuously without a break to an entire inner surface of the lid unit facing the retention part and to the entire bottom surface of the retention part.

2. The container for centrifugal separation, as defined in claim 1, the container comprising:

a lid unit to be set toward an opening of the retention part of the container main body, wherein the material having thixotropic properties has been applied also to an inner surface of the lid unit facing the retention part.

3. The container for centrifugal separation, as defined in claim 1, wherein the material having thixotropic properties has specific gravity in the middle of specific gravities of two components that are centrifugally separated from each other.

4. The container for centrifugal separation, as defined in claim 1, wherein the thickness of a coating formed by application of the material having thixotropic properties is greater than or equal to 5 μm and less than or equal to 1000 μm.

5. The container for centrifugal separation, as defined in claim 1, wherein the bottom surface of the retention part includes a funnel-shaped inclined surface.

6. The container for centrifugal separation, as defined in claim 1, wherein the material having thixotropic properties is gel.

7. The container for centrifugal separation, as defined in claim 1, wherein a trap part in which a component having relatively high specific gravity is stored when centrifugal separation has been performed on the sample is provided at an opening edge part of the container main body.

8. The container for centrifugal separation, as defined in claim 7, wherein the material having thixotropic properties has been applied to an inner surface of the trap part.

9. A method for producing the container for centrifugal separation, as defined in claim 1, wherein the material having thixotropic properties is applied by spin coating.

10. The container for centrifugal separation, as defined in claim 1, wherein:

the bottom surface of the retention part includes a funnel-shaped inclined surface; and a depression portion is formed in a part of the inclined surface.

11. The container for centrifugal separation, as defined in claim 1, wherein the bottom surface of the retention part includes a bottom part that has a convex curved surface.

12. The container for centrifugal separation, as defined claim 1, wherein a thickness of a coating formed by application of the material having thixotropic properties is greater than or equal to 200 μm and less than or equal to 1000 μm.

13. A container for centrifugal separation comprising:

a container main body including a retention part in which a sample is retained, wherein a component of the sample in the retention part is centrifugally separated by rotating the container main body about its center axis, as a rotation axis, and wherein material having thixotropic properties has been applied to an entire bottom surface of the retention part; and a lid unit provided at an opening of the retention part of the container main body, wherein the material having thixotropic properties has been evenly coated continuously without a break to an entire inner surface of the lid unit facing the retention part and to the entire bottom surface of the retention part, wherein the bottom surface of the retention part includes a funnel-shaped inclined surface; and a depression portion is formed in a part of the inclined surface.

* * * * *